US006182364B1

(12) United States Patent
Reyburn

(10) Patent No.: US 6,182,364 B1
(45) Date of Patent: Feb. 6, 2001

(54) SAFETY STOCK CARTON KNIFE TIP ASSEMBLY AND METHOD OF MAKING

(76) Inventor: Thomas P. Reyburn, 127 E. Maple, Fruitport, MI (US) 49415

( * ) Notice: Under 35 U.S.C. 154(b), the term of this patent shall be extended for 0 days.

(21) Appl. No.: 09/144,549

(22) Filed: Sep. 1, 1998

(51) Int. Cl.[7] ..... B67B 7/00

(52) U.S. Cl. ..... 30/2; 30/2; 30/286; 30/289; 30/294; 30/317; 30/DIG. 8

(58) Field of Search ..... 30/2, 286, 289, 30/294, 317, DIG. 8

(56) References Cited

U.S. PATENT DOCUMENTS

| | | | | |
|---|---|---|---|---|
| D. 254,243 | | 2/1980 | Florian | D8/98 |
| 601,315 | | 3/1898 | Creveling | 30/294 |
| 1,498,753 | | 6/1924 | Rendlich | 30/286 |
| 1,546,975 | | 7/1925 | Feller | 30/286 |
| 1,562,429 | | 11/1925 | Unsinger | 30/2 |
| 1,795,527 | | 3/1931 | Tyreman | 30/2 |
| 2,095,164 | | 10/1937 | Babb | 30/2 |
| 2,120,960 | * | 6/1938 | Arthur . | |
| 2,274,799 | * | 3/1942 | Kroemer . | |
| 2,376,887 | * | 5/1945 | Walters . | |
| 2,593,601 | * | 4/1952 | Pollak . | |
| 2,681,502 | | 6/1954 | Black | 30/286 |
| 2,764,814 | | 10/1956 | Jecker | 30/317 |
| 2,797,477 | | 7/1957 | Erdman | 30/2 |
| 3,092,903 | * | 6/1963 | Bockhold . | |
| 3,100,935 | | 8/1963 | Leafe | 30/294 |
| 3,178,812 | | 4/1965 | Lurie | 30/2 |
| 3,187,354 | | 6/1965 | Frisbie | 7/14.1 |
| 3,324,548 | | 6/1967 | Mascia | 30/125 |
| 3,600,806 | | 8/1971 | Naccash | 30/294 |
| 3,673,687 | | 7/1972 | Phillips | 30/294 |
| 4,048,719 | | 9/1977 | Thompson | 30/2 |
| 4,086,698 | | 5/1978 | Sparks | 30/2 |
| 4,167,810 | | 9/1979 | Gilbert | 30/2 |
| 4,198,751 | | 4/1980 | Egbert | 30/286 |
| 4,489,489 | * | 12/1984 | Sarto | 30/2 |
| 4,604,804 | * | 8/1986 | Sparks | 30/294 |
| 4,631,829 | | 12/1986 | Schmidt | 30/294 |
| 4,662,070 | | 5/1987 | Reddig | 30/294 |
| 5,054,198 | | 10/1991 | Gmoch | 30/2 |
| 5,142,780 | | 9/1992 | Brewer | 30/294 |
| 5,282,316 | | 2/1994 | Anderson | 30/294 |
| 5,412,871 | | 5/1995 | Reyburn | 30/2 |
| 5,539,983 | | 7/1996 | Reyburn | 30/2 |
| 5,939,209 | * | 8/1999 | Shibuya et al. | 428/532 |

* cited by examiner

*Primary Examiner*—Stephen F. Gerrity
*Assistant Examiner*—Paul D. Kim
(74) *Attorney, Agent, or Firm*—Price, Heneveld, Cooper, DeWitt & Litton

(57) ABSTRACT

A stock carton knife including a handle and a blade projecting from the handle and having two lateral edges and an outer end. The blade has a lateral cutting notch in one of the lateral edges, the cutting notch having a laterally oriented mouth including an inner edge closer to the handle and an outer edge farther from the handle. The outer edge converges with the outer end to form a juncture. The juncture has a configuration which includes at least one lateral recess. The safety carton knife further includes a blunt knob bonded on the juncture by a bonding material which is in the least one recess, thereby securing the knob to the blade.

15 Claims, 1 Drawing Sheet

SAFETY STOCK CARTON KNIFE TIP ASSEMBLY AND METHOD OF MAKING

BACKGROUND OF THE INVENTION

A unique stock carton safety knife was previously developed, as set forth in U.S. Pat. Nos. 5,412,871 and 5,539,983, both incorporated by reference herein. The outer blade juncture of the knife has a blunt knob such as a sphere, as part of the patented combination. The present invention relates to a unique attachment of the knob to the blade.

SUMMARY OF THE INVENTION

The present invention was made to achieve easy and secure attachment of the blunt knob to the blade tip of a stock carton safety knife. The blade tip has a special configuration for effective securement of the blunt knob to the blade, creating an excellent bonded joint. The configuration has a narrower central portion laterally straddled by a pair of cavities, and axially straddled by a pair of wider portions, the knob being bonded in place encompassing the central portions and the bonding material filling the cavities.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
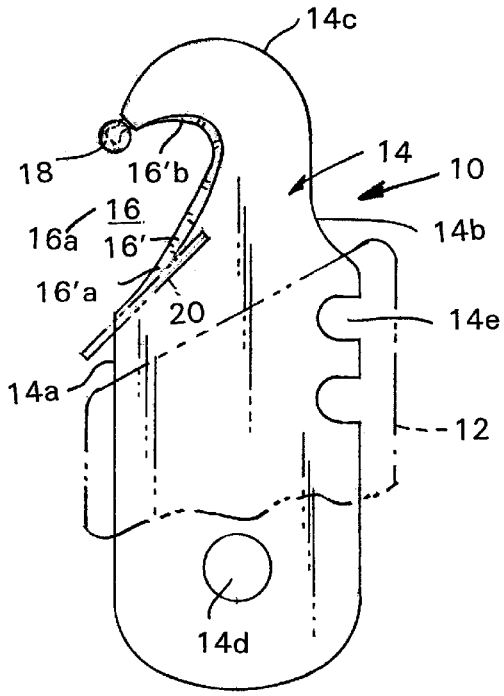
FIG. 1 is a side elevational view of the knife, emphasizing one embodiment of the blade, with the handle shown in phantom.
Figure 2:
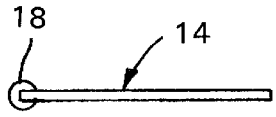
FIG. 2 is an end elevational view of the blade.

Referring now specifically to the drawings, the stock carton knife 10 there depicted comprises an elongated handle 12 shown in phantom lines and having at one end a protruding extend through the blade orifice 14*d* to secure blade 14 in place in the handle. Conventional handle protrusions (not shown) extend into blade cavities 14*e* to assist in locking it in place in the usual manner.

The blade is of thin, flat metal, namely steel. The exposed end of blade 14 has a pair of blunt i.e., dull lateral edges 14*a* and 14*b* which form the front and back edges of the blade respectively, and a rounded, convex, outer end 14*c* with a dull edge. In lateral edge 14*a* is a lateral cutting notch 16 which has a laterally opening mouth 16*a* and a sharpened cutting edge 16'. Notch 16 is generally diagonally oriented relative to the elongated dimension of the knife, extending diagonally from mouth 16*a* toward outer end 14*c* of blade 14. Cutting edge 16' includes a sharp inner edge 16*a* closer to handle 12, and a sharp outer edge 16*b* further away from the handle and closer to the outer end 14*c*. Outer edge 16*b* joins end 14*c* of the blade to form a juncture. The juncture is provided with a blunt knob 18. This knob has a width considerably greater than the blade width and although preferably is in the form of a sphere, may take other blunt configurations such as a teardrop shape. There is no sharp point at this outer edge of mouth 16*a*, i.e., at the juncture.

An optional feature along the inner edge of edge 16'*a* is a diagonal, flat guide and safety plate 20 shown in phantom lines, extending generally parallel to edge 16'*a* and oriented normal to the plane of blade 14. It straddles the blade so as to protrude from the two opposite faces of blade 14, and acts as a guard plate oriented toward the handle to protect the fingers of a user of the knife, all as set forth in the above-identified patents.

Figure 3:
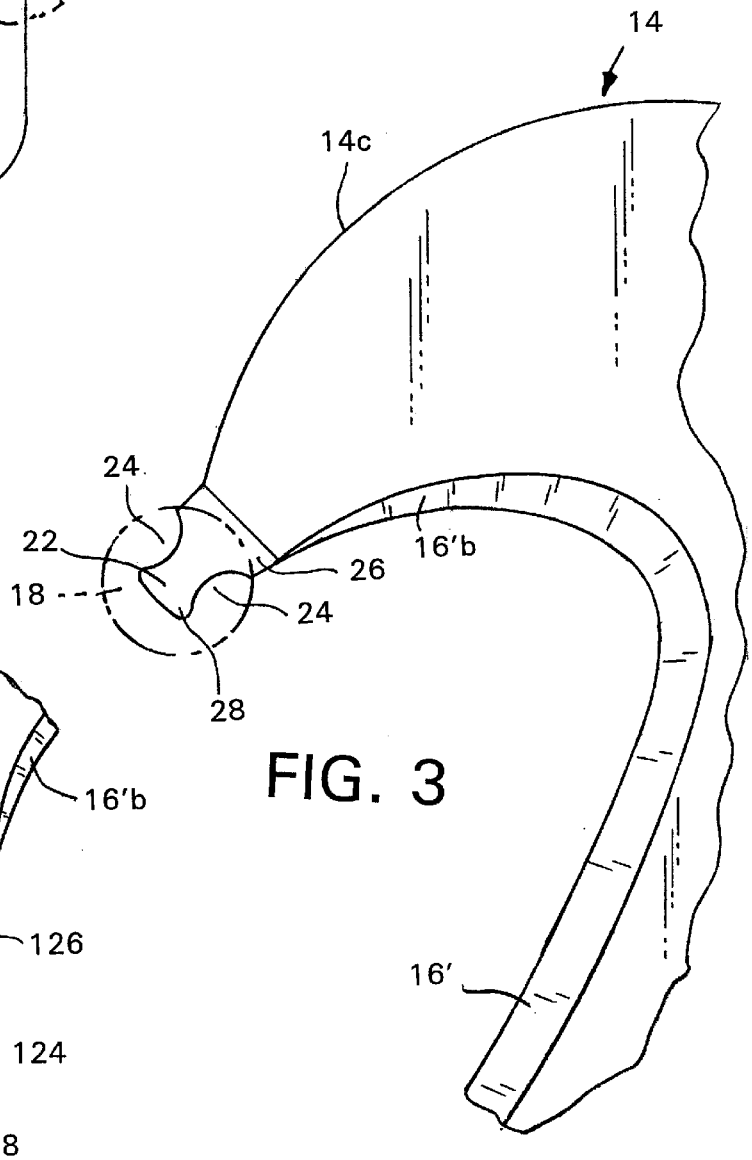
FIG. 3 is an enlarged, fragmentary view of a portion of the blade, depicting the special joint configuration of the blade tip.

This present invention was developed to enable blunt knob 18 to be easily and securely attached to the juncture of blade edge 16*b*' and dull edge 14*c*. A secure attachment is achieved by having a special configuration of the juncture as shown in detail in FIG. 3. Specifically, the juncture has at least one recess and preferably two recesses laterally astraddle a narrower central portion. In FIG. 3 it takes the form of a two-dimensional hourglass having narrow portion 22 laterally straddled by the pair of recesses 24, and longitudinally straddled by wider base portion 26 and wider distal end portion 28. Knob 18 has a slot to fit over this juncture of the blade. The knob may be bonded to the juncture by inserting the bonding material into the slot of knob 18 and/or applying it to the blade juncture, such that when knob 18 is slid onto the juncture, the bonding material will fill recesses 24. Solidification of the bonding material thereby locks the knob onto the blade. Preferably the bonding material is of a thermosetting type polymer which is subsequently cured after the knob is applied. Curing can occur simply by time lapse and/or application of heat or radiation, depending upon the particular bonding material selected from those commercially available. Preferably the bonding material is of an epoxy polymer material or the equivalent, utilizing thermosetting characteristics to secure the knob in place. Several thermosetting polymers are well known, including phenolics, polyesters, epoxides, silicones, polyethylenes, alkyls and others. Alternatively, the bond may be formed by molding the blunt knob onto the blade juncture, with the knob material flowing into recesses 24 to lock the knob in place. The molded knob is of a polymer, particularly a thermosetting polymer such as those noted above. Alternatively, it can be formed of a metal, or a ceramic material, preferably a metal with a melting point below temperatures at which the hardened steel blade edge would lose its temper.

Figure 4:
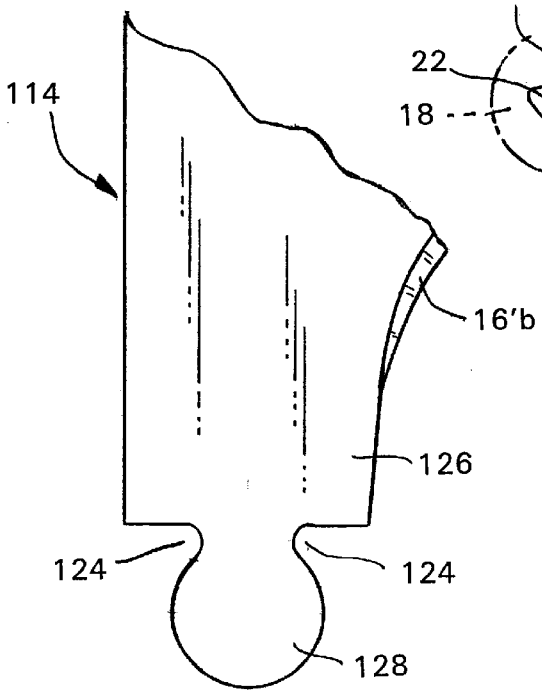
FIG. 4 is a greatly enlarged, fragmentary, elevational view of a second embodiment of the blade.

In FIG. 4 is shown a second embodiment blade 114 with the juncture having recesses 124 astraddle a narrow portion, a wider base portion 126 and an enlarged, generally circular distal end portion 128. This is presently the preferred configuration. Preferably the knob is molded in place on the blade juncture, being of a polymer as noted above, or alternatively a metal or ceramic.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A safety carton knife comprising:

a handle;

a blade projecting from said handle, having two lateral edges and an outer end;

said blade having a lateral cutting notch in one of said lateral edges, said cutting notch having a laterally oriented mouth including an inner edge closer to said handle and an outer edge farther from said handle;

said outer edge converging with said outer end to form a juncture;

said juncture having a configuration which includes at least one lateral recess;

a blunt knob bonded on said juncture by a bonding material which is in said at least one recess, securing said knob to said blade.

2. The safety carton knife in claim 1 wherein said juncture has two recesses.

3. The safety carton knife of claim 2 wherein said knob is bonded onto said juncture with a thermosetting material.

4. The safety carton knife in claim 1 wherein said juncture has a narrow portion straddled by a pair of recesses.

5. The safety carton knife of claim 1 wherein said configuration has a two-dimensional generally hourglass shape.

6. The safety carton knife of claim 1 wherein said knob is bonded to said juncture by polymer material in said at least one recess.

7. The safety carton knife of claim 6 wherein said polymer material is a thermosetting polymer.

8. A safety carton knife comprising:

a handle;

a blade projecting from said handle, having two lateral edges and an outer end;

said blade having a lateral cutting notch in one of said lateral edges, said cutting notch having laterally oriented mouth including an inner edge closer to said handle and an outer edge farther from said handle;

said outer edge converging with said outer end to form a juncture;

said juncture having a configuration which includes a narrow portion straddled by a pair of recesses;

a blunt knob molded onto said juncture and into said recesses.

9. The safety carton knife in claim 8 wherein said knob is of polymer, metal or ceramic.

10. A safety carton knife comprising:

a handle;

a blade projecting from said handle, having two lateral edges and an outer end;

said blade having a lateral cutting notch in one of said lateral edges, said cutting notch having a laterally oriented mouth including an inner edge closer to said handle and an outer edge farther from said handle;

said outer edge converging with said outer end to form a juncture;

said juncture having a configuration which includes at least one lateral recess;

a blunt knob having a slot therein, said slot receiving said juncture to cause said knob to be fitted onto said juncture; and a bonding material in said slot and recess, securing said knob to said blade.

11. The safety carton knife in claim 10 wherein said juncture has two recesses.

12. The safety carton knife of claim 11 wherein said knob is bonded onto said juncture with a thermosetting material.

13. The safety carton knife in claim 10 wherein said configuration has a two-dimensional hourglass shape.

14. The safety carton knife of claim 10 wherein said knob is bonded to said juncture by polymer material in said at least one recess.

15. The safety carton knife of claim 14 wherein said polymer material is a thermosetting polymer.

* * * * *